US006202385B1

(12) United States Patent
Kim

(10) Patent No.: US 6,202,385 B1
(45) Date of Patent: Mar. 20, 2001

(54) DROPPING APPARATUS FOR AUTOMATIC TABLET SORTING AND COUNTING MACHINE

(76) Inventor: Jin Soo Kim, 224-37 Naedang-Dong, Suh-gu, Daegu (KR)

( * ) Notice: Subject to any disclaimer, the term of this patent is extended or adjusted under 35 U.S.C. 154(b) by 0 days.

(21) Appl. No.: 09/365,062

(22) Filed: Jul. 30, 1999

(30) Foreign Application Priority Data

Aug. 4, 1998 (KR) ..... 98-14638

(51) Int. Cl.[7] ..... B65B 35/54
(52) U.S. Cl. ..... 53/154; 53/168
(58) Field of Search ..... 53/131.5, 154, 53/155, 168

(56) References Cited

U.S. PATENT DOCUMENTS 5,787,678 * 8/1998 Koike et al. ..... 53/154
5,839,257 * 11/1998 Soderstrom et al. ..... 53/168
5,946,883 * 9/1999 Yuyama et al. ..... 53/154

* cited by examiner

*Primary Examiner*—Peter Vo
*Assistant Examiner*—Nathaniel Chukwurah
(74) *Attorney, Agent, or Firm*—John K. Park; Park & Sutton LLP

(57) ABSTRACT

A tablet dropping unit for an automatic tablet dispensing system is disclosed, and an automatic tablet dispensing system which incorporating the tablet dropping unit is disclosed. The automatic tablet dispensing system includes a drum unit communicating with a plurality of release holes which fixate a plurality of tablet cassettes, storing therein and releasing therefrom, a measured quantity of tablets. Tablet released from the tablet cassettes drop via release holes to a guide hopper of a tablet packaging unit. The packing unit packages the tablets released from the tablet dropping unit and discharges the packaged tablet bags to an exterior of the automatic tablet dispensing system. The drum unit has a pair of arc-shaped drum bodies partitioned by a predetermined space therebetween. An auxiliary arc-shaped drum is further located within each of the arc-shaped drum bodies.

8 Claims, 4 Drawing Sheets

DROPPING APPARATUS FOR AUTOMATIC TABLET SORTING AND COUNTING MACHINE

BACKGROUND OF THE INVENTION

1. Field of Invention

The present invention relates to a tablet dispensing system, and more specifically to an improved tablet dropping unit for an automatic tablet dispensing system which guides the dropping of tablets released from respective tablet cassettes to a tablet packaging unit therebelow based upon information input in the automatic tablet dispensing system.

2. Description of the Prior Art

Generally, automatic tablet dispensers are employed in hospitals and drugstores to automate the output and assembly of corresponding tablets when the prescription is input into a computer while also serving to dispense the per-dosage assembled tablets.

Such an automatic tablet dispensing system includes: a main computer for enabling an appropriate prescription on the basis of proper medicine, intake method, daily intake frequency and intake duration depending upon each patient; a tablet dropping unit having a plurality of tablet cassettes and a drum for storing therein and releasing therefrom the tablets in correspondence to the prescription set up in the computer; and a packaging unit disposed below the tablet dropping unit and serving to package the output tablets and releasing the same to an exterior of the automatic tablet dispenser.

The packaging unit is made up of: a release hopper for assembling the tablets being dropped from the tablet drop unit; a heater assembly for packaging the tablets being discharged through the release hopper; a printer for printing respective information on packaging paper; and a release conveyer for externally discharging the medicine bags containing tablets. Essentially, the tablet dropping unit serves to guide the tablets released from respective tablet cassettes to the packaging unit therebelow on the basis of information input in the main computer.

Such a tablet dropping unit is provided above the packaging unit in a cylindrical drum type and rotated by a motor disposed at an upper portion thereof, and also a guide roller disposed at a lower portion thereof enables its stable rotation.

A plurality of tablet cassettes storing therein a certain amount of tablets are attached onto and along the outer periphery of the drum. The tablets in the tablets cassettes are transferred through release holes of the drum into the packaging unit.

The single drum type tablet dropping unit has developed into a double drum type having an inner drum and an outer drum to increase tablet cassette mounting capacity.

However, the double drum type of tablet dropping unit according to the conventional art have disadvantages in that: (1) a wire arrangement to control the respective tablets cassettes can become complicated with inevitable tangling; (2) severe noise and consequent error may occur during operation due to the complicated wiring, thereby hindering an accurate release of tablets; and (3) maintenance cost may increase with breakdown and cassette replacement resulting from the complicated wiring.

Furthermore, the linearly provided release holes may delay the tablet dropping and cause the tablets to flow into other tablet cassettes, thereby deteriorating smooth packaging operation in the packaging unit. That is, the tablet dropping is delayed such that the tablets being dropped from the tablet cassettes mounted on an upper portion of the drum may take a longer time period to reach the lower portion thereof since the dropping tablets may hit against the inner periphery of the drum instead of dropping through the central shaft of the drum.

SUMMARY OF THE INVENTION

The present invention is contrived to overcome the conventional disadvantages. Therefore, it is an object of the present invention to provide a tablet dropping unit for an automatic tablet dispensing system, wherein the drum and release holes of the conventional tablet dropping unit are improved to mount a larger quantity of tablet cassettes on the improved drum while further facilitating the tablet dropping operation.

To achieve the above-described object, there is provided a tablet dropping unit for an automatic tablet dispensing system according to the present invention. The tablet dispensing system includes the tablet dropping unit having a drum body communicating with a plurality of release holes which fixate a plurality of tablet cassettes that stores therein and releases therefrom a predetermined quantity of tablets. Released tablets drop via the release holes to a guide hopper which guides the tablets to a the packaging unit. The packaging unit packages the tablets released from the tablet dropping means and discharges packaged tablet bags to an exterior of the automatic tablet dispensing system. The drum body of the tablet dropping means is partitioned to at least two semicircular drums having a predetermined space therebetween.

DETAILED DESCRIPTION OF THE PREFERRED EMBODIMENTS

With reference to the accompanying drawings, the present invention will now be described.

Figure 1:
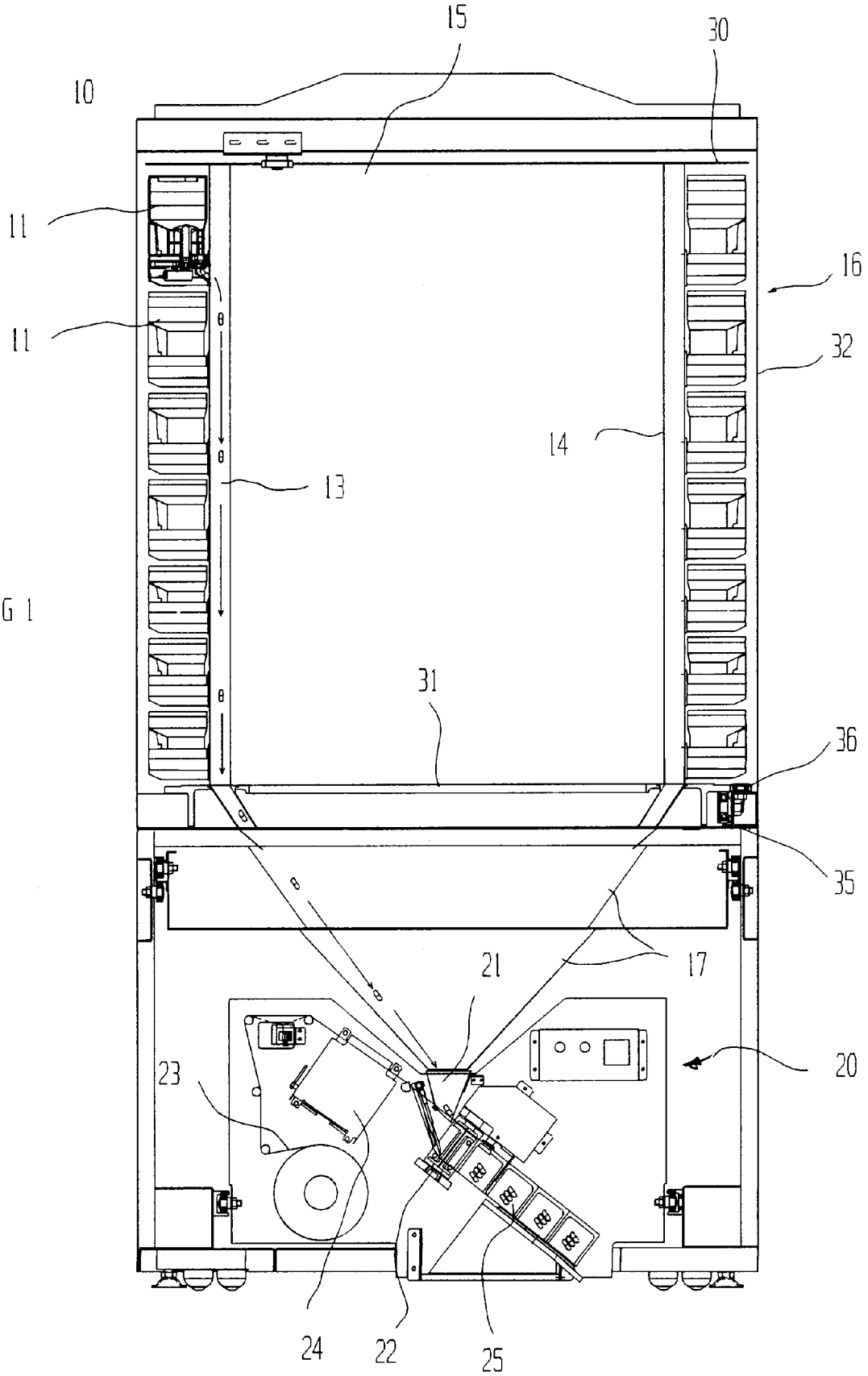
FIG. 1 is a front view illustrating a conventional single drum automatic tablet dispensing system with a front panel removed to show the inner components.

As shown in FIGS. 1, a conventional automatic tablet dispenser 10 includes a tablet dropping unit 16 having a cylindrical drum unit 15 with release holes 13, 14 engaged thereto so as to communicate with a plurality of tablet cassettes 11. The tablet cassettes 11 respectively store therein tablets and release a measured quantity of tablet therefrom into corresponding release holes 13, 14, so that the tablets released from the tablet cassettes 11 fall through the release holes 13, 14.

Below the tablet dropping unit 16 there is provided a guide hopper 17 for safely guiding the tablets being released through the release holes 13, 14 so that the tablets may not be dispersed.

A packaging unit 20 is disposed below the guide hopper 17 to package and discharge the released tablets outside the automatic tablet dispenser 10. The packaging unit 20 includes a release hopper 21 for gathering the tablets dropped from the tablet dropping unit 16, a heater assembly 22 for packaging the tablets released through the release hopper 21, a printer 24 for printing respective information on the packaging paper 23, and a discharge conveyer 25 for externally releasing respective tablet-packaged bags.

The automatic tablet dispenser 10 is controlled by the main computer (not shown) which is informed of an appropriate prescription for a target patient which can include proper medicine, intake method, daily intake frequency, and intake duration.

Figure 2:
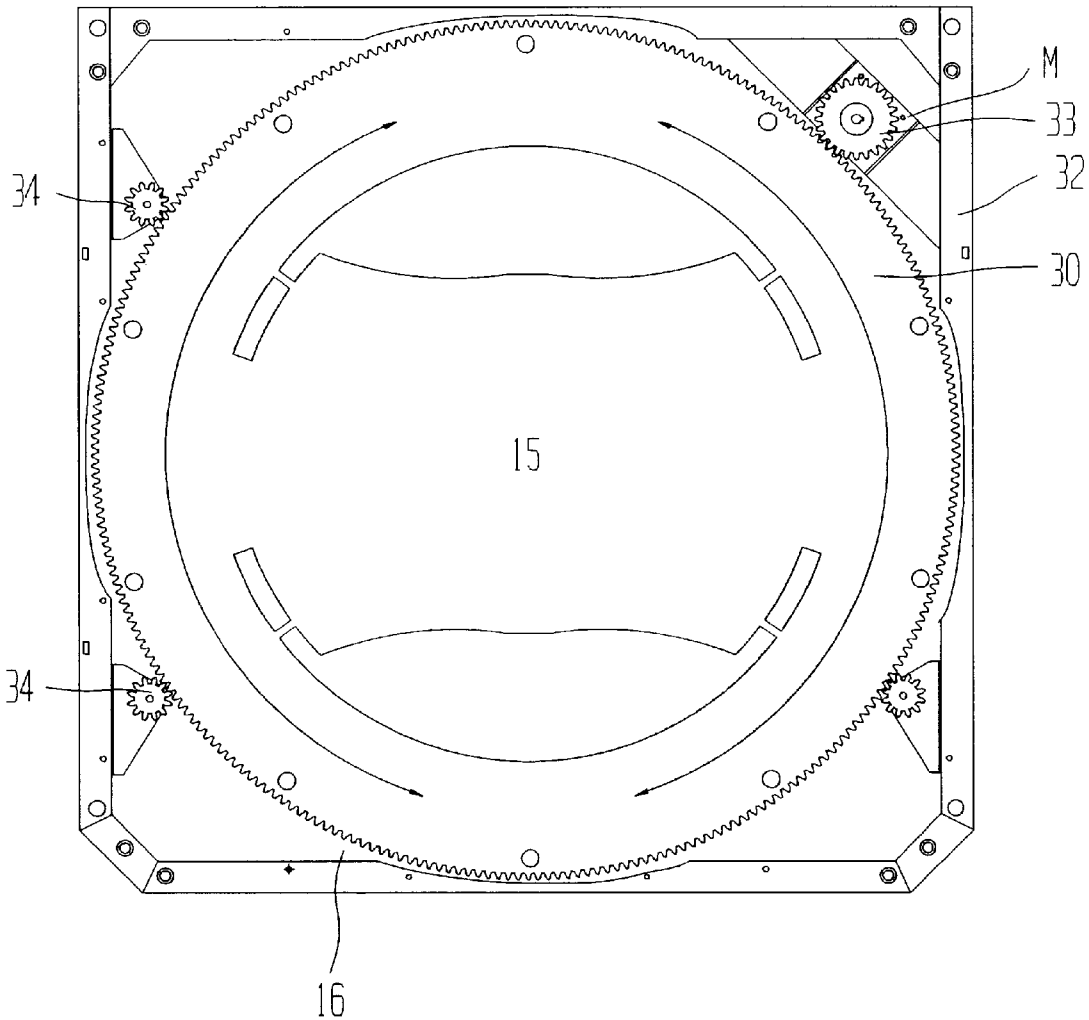
FIG. 2 is a schematic plan view illustrating a driving member of the automatic tablet dispensing system according to the present invention.
Figure 3:
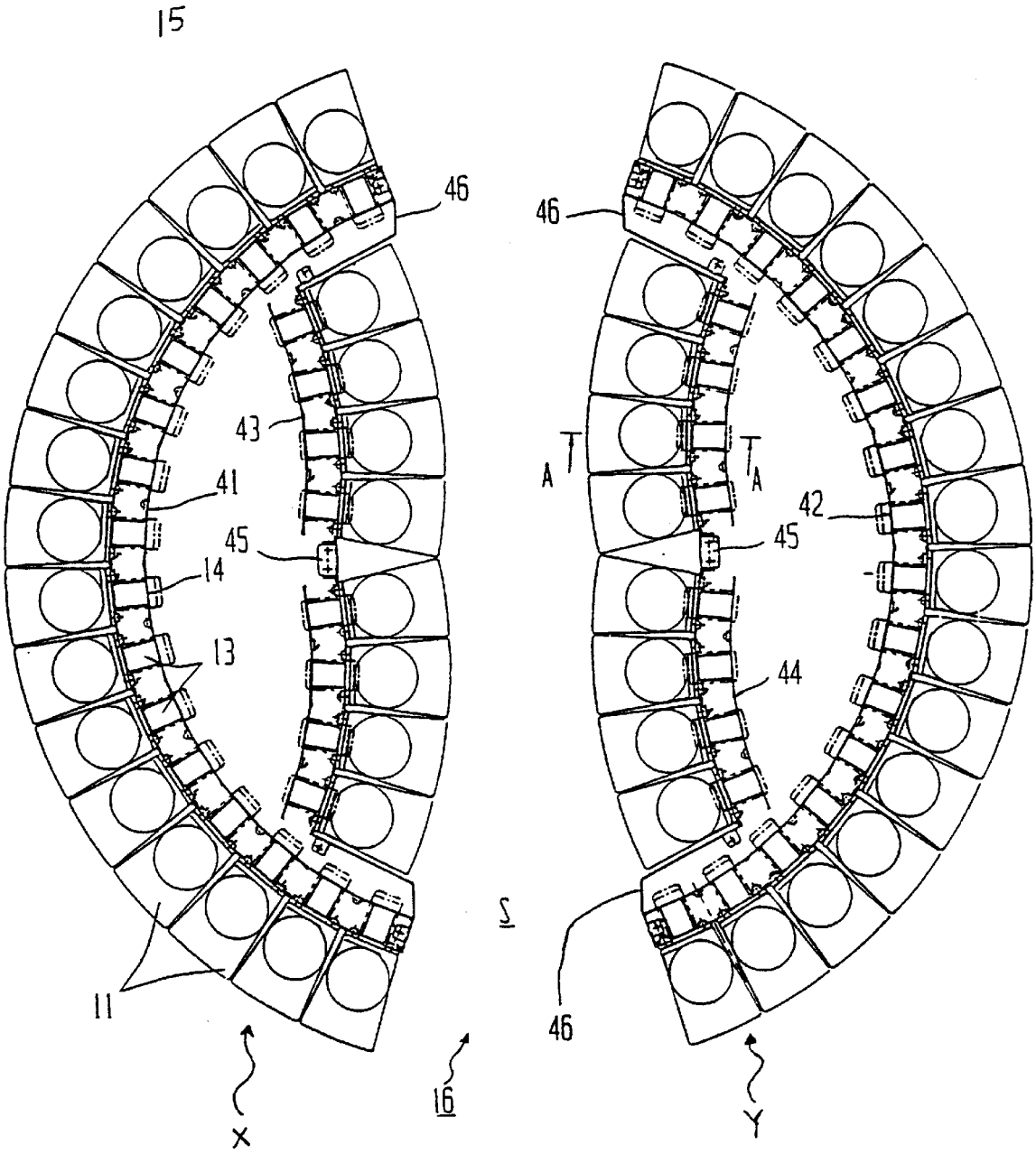
FIG. 3 is a cross-sectional plan view illustrating a tablet dropping unit of the automatic tablet dispensing system according to the present invention.
Figure 4:
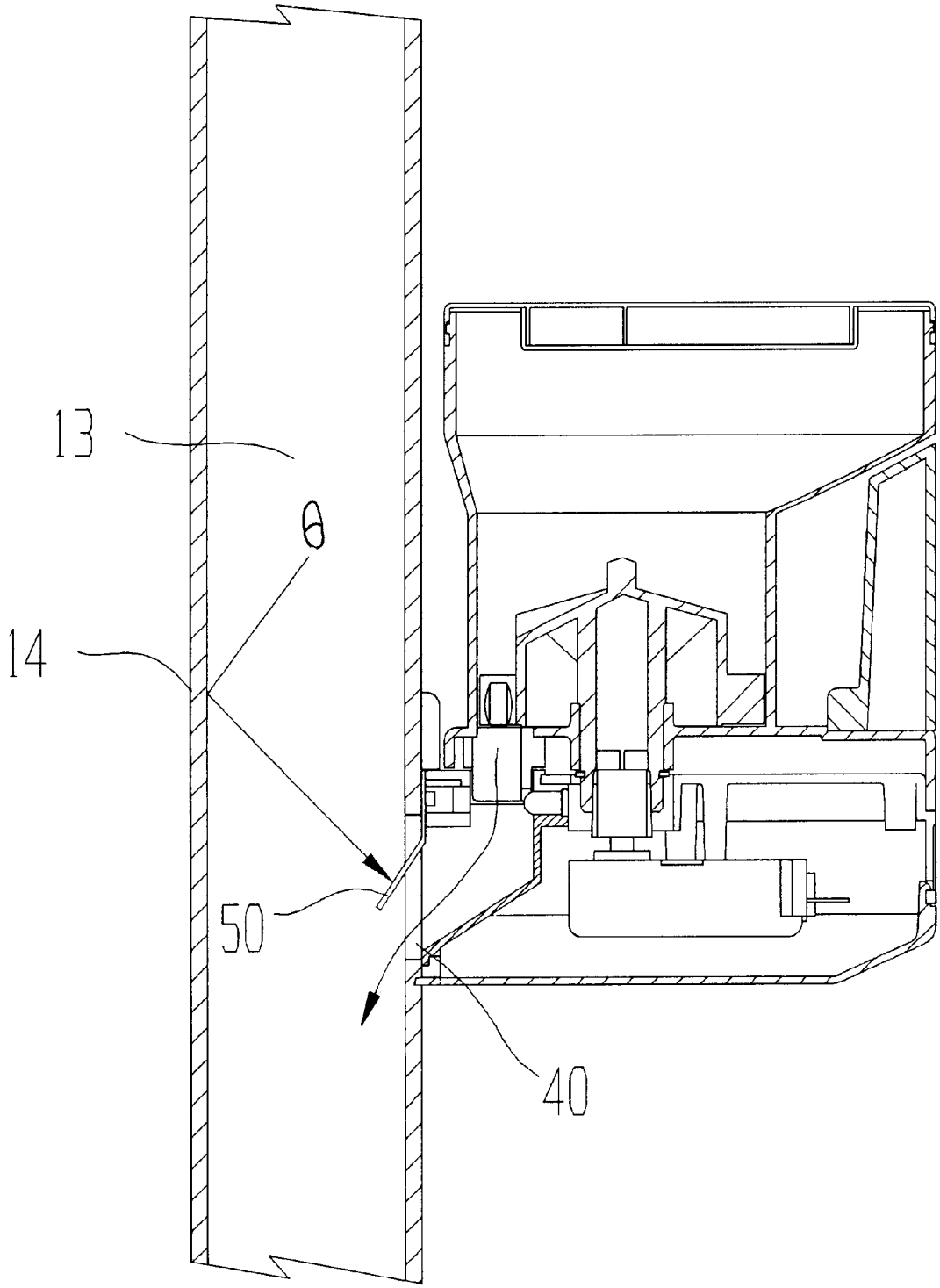
FIG. 4 is a cross-sectional view taken along line A—A of FIG. 3.

The tablet dropping unit 16 according to the present invention is illustrated in FIGS. 2 through 4. The tablet dropping unit 16 is operably supported by a gear plate 30 fixed on top of a pair of drum bodies X, Y and by a guide plate 31 (shown in FIG. 1) fixed beneath the drum bodies X, Y. The gear plate 30 is provided such that it rotates in a clockwise or counterclockwise direction in combination with a driving gear 33 fixed to a motor M fixedly attached to a body case 32 and a plurality of auxiliary gears 34 provided along the periphery of the gear plate 30.

The guide plate 31 fixed beneath the lower bottom of the drum bodies X, Y is disposed to desirably rotate in correspondence to a plurality of guide rollers 35, 36 which are respectively fixed to the body case 32.

The present invention provides an improved construction of the drum 15 into drum bodies X, Y in the tablet dropping unit 16 and an improved release hole 13 formed within the release guide 14 of the drum bodies X, Y, thereby enabling a larger number of tablet cassettes 11 to be mounted along the drum bodies X, Y as well as facilitating a smooth tablet dropping. As shown in FIG. 4, a release openings 40 is formed through the wall of the release guide 14 at a point of attachment with each individual tablet cassette 11 to facilitate the release of tablets therethrough. The release guide 14 is provided to form a circularly provided pair of arc-shaped drum bodies X, Y of the tablet dropping unit 16. Between the arc-shaped drum bodies X, Y, there is maintained a predetermined space S to designate a left drum 41 and a right drum 42.

A pair of auxiliary arc-shaped drums 43, 44 are correspondingly provided inside each of the left and right arc-shaped drum pair 41, 42. A connection fragment 45 is provided to engage the auxiliary drum pair 43, 44 therebetween.

Each end of the connected arc-shaped auxiliary drum pair 43, 44 is fixed to a corresponding end of the left and right arc-shaped drum pair 41, 42 using a bracket 46, thereby forming the whole drum bodies X, Y.

As shown in FIG. 4, a guide plate 50 formed on the release guide 14 slants downward from above each release opening 40 so as to prevent tablets being dropped through the release hole 13 from flowing into the release opening 40. Here, the release opening 40 formed through the wall of the release guide 14 serves to guide the tablets being dropped from a target tablet cassette 11 into the release hole 13.

The guide plate 50 is preferably formed of a thin film, such as PE film, which is sufficiently elastic so as to not damage the tablets being dropped thereon.

As described above, the present invention enables a large number of tablets cassettes 11 to be mounted onto the outer periphery of the release guides 14 of the drum bodies X, Y.

That is, when the prescription is input in a main computer, the tablets contained in the respective tablet cassettes 11 are released by a known driving device, and the released tablets are flowed through the release opening 40 formed along the release guide 14 into the release hole 13 and down to the packaging unit 20.

The tablets dropped into the packaging unit 20 are packed with one-dosage quantity in combination with the release hopper 21, the packaging paper 23, the heater assembly 22 and the printer 24. Then, the per-dosage packaged envelopes are externally discharged by a release conveyer 25. Such serial operations are identical to those of the conventional art and accordingly detailed description will be omitted. Instead, the tablet dropping unit 16 will be explained in further detail.

Specifically, tablets released from the tablet cassettes 11 may hit along the inner walls of the release holes 13 and flow into other release openings 40 accordingly, such disadvantages are overcome by the guide plate 50 which serves to prevent the dropping tablets from flowing into other release openings 40.

In the present invention, the drum bodies X, Y of the tablet dropping unit 16 are constituted in semicircular arc-shaped left and right drums 41, 42 which are respectively attached circularly by the arc-shaped auxiliary drums 43, 44, thereby realizing a smoother tablet dispensing operation while maintaining tablet cassette mounting capacity equivalent to that of a conventional twofold drum system.

In addition, the predetermined space S secured between the drum bodies X, Y, allows an operator convenient and easy access to the auxiliary drums 43, 44 located between the left and right drums 41, 42 to replace and maintain the tablet cassettes 11 therebetween. Also, any circuit wires are advantageously gathered through respective holes formed by the left drum 41 and the corresponding auxiliary drum 43 and by the right drum 42 and the corresponding auxiliary drum 44. This overcomes the conventional wiring disadvantage of the conventional twofold drum system by which circuit wires are rendered to constant tangling with each other caused by the reverse rotation of dual concentric drum systems.

As discussed above, the tablet dropping unit for an automatic tablet dispensing system according to the present invention improves the conventional drum and the tablet release openings of the release holes while realizing a unitary drum body, thereby accomplishing a smoother tablet dropping operation as well as realizing a large quantity of tablet cassette mounting.

What is claimed is:

1. An automatic tablet dispenser comprising a tablet dropping unit having a drum unit comprised of a plurality of vertically elongated release guides having disposed thereon a plurality of tablet cassettes for storing and releasing tablets, via release holes disposed within said release guides, down to a means disposed below said tablet dropping unit for packaging the tablets released from the tablet dropping unit and discharging packaged tablet bags to an exterior of the automatic tablet dispensing system, wherein said drum unit is partitioned into at least two drum bodies having a predetermined space therebetween, and a means to rotate said tablet dropping unit comprising:

a rotating gear plate fixed on top of said drum bodies;

a guide plate fixed beneath said drum bodies;

a motor attached to said automatic tablet dispenser adjacent said gear plate;

a driving gear fixedly attached to said motor, said motor rotatably engaged to said gear plate for rotating said gear plate; and a plurality of auxiliary gears provided along the periphery of said gear plate.

2. The automatic tablet dispenser as described in claim 1 further comprising a guide plate formed on each of said release guides above each of a plurality of release openings formed through said release guides, each of said release openings being disposed at a predetermined point corresponding to one of said tablet cassettes for facilitating the release of tablets therethrough into said release hole, said guide plate slanting downward to prevent tablets being dropped through said release hole from flowing into said release opening, wherein said release guides of each of said drum bodies are arranged to form, in a top plan view, an arc-shaped drum body having a second arc-shaped drum body.

3. The automatic tablet dispenser as described in claim 2, wherein said guide plates are elastic and respectively formed of a thin material.

4. The automatic tablet dispenser as described in claim 3, wherein said guide plates are made of PE film.

5. A tablet dropping unit for an automatic tablet dispenser having a drum unit comprised of a plurality of vertically elongated release guides having disposed thereon a plurality of tablet cassettes for storing and releasing tablets, via release holes disposed within said release guides, down to a means disposed below said tablet dropping unit for packaging the tablets released from the tablet dropping unit and discharging packaged tablet bags to an exterior of the automatic tablet dispensing system, at least two drum bodies partitioned by a predetermined space therebetween, said tablet dropping unit including, a means to rotate said tablet dropping unit comprising:

a rotating gear plate fixed on top of said drum bodies;

a guide plate fixed beneath said drum bodies;

a motor attached to said automatic tablet dispenser adjacent said gear plate;

a driving gear fixedly attached to said motor, said motor rotatably engaged to said gear plate for rotating said gear plate; and a plurality of auxiliary gears provided along the periphery of said gear plate.

6. The tablet dropping unit as described in claim 5 further comprising a guide plate formed on each of said release guides above each of a plurality of release openings formed through said release guides, each of said release openings being disposed at a predetermined point corresponding to one of said tablet cassettes for facilitating the release of tablets therethrough into said release hole, said guide plate slanting downward to prevent tablets being dropped through said release hole from flowing into said release opening, wherein said release guides of each of said drum bodies are arranged to form, in a top plan view, an arc-shaped drum body having a second arc-shaped drum body.

7. The tablet dropping unit as described in claim 6, wherein said guide plates are elastic and respectively formed of a thin material.

8. The tablet dropping unit as described in claim 7, wherein said guide plates are made of PE film.

* * * * *